US008240697B2

(12) United States Patent
Silva

(10) Patent No.: US 8,240,697 B2
(45) Date of Patent: Aug. 14, 2012

(54) GLIDING BOARD

(75) Inventor: Gilles Silva, Le Montcel (FR)

(73) Assignee: Salomon S.A.S., Metz-Tessy (FR)

( * ) Notice: Subject to any disclaimer, the term of this patent is extended or adjusted under 35 U.S.C. 154(b) by 109 days.

(21) Appl. No.: 12/823,418

(22) Filed: Jun. 25, 2010

(65) Prior Publication Data

US 2010/0327560 A1 Dec. 30, 2010

(30) Foreign Application Priority Data

Jun. 26, 2009 (FR) ..... 09 03107

(51) Int. Cl.
*A63C 5/07* (2006.01)

(52) U.S. Cl. ..... 280/602; 280/607

(58) Field of Classification Search ..... 280/11.14, 280/601, 602, 607, 609, 610, 611
See application file for complete search history.

(56) References Cited

U.S. PATENT DOCUMENTS

| | | | | |
|---|---|---|---|---|
| 4,523,772 | A * | 6/1985 | Arnsteiner | 280/610 |
| 4,556,237 | A * | 12/1985 | Meatto et al. | 280/610 |
| 4,706,985 | A * | 11/1987 | Meatto | 280/610 |
| 5,173,226 | A | 12/1992 | Cazaillon et al. | |
| 5,183,618 | A | 2/1993 | Pascal et al. | |
| 5,292,148 | A * | 3/1994 | Abondance et al. | 280/602 |
| 5,332,252 | A | 7/1994 | LeMasson et al. | |
| 5,449,425 | A | 9/1995 | Renard et al. | |
| 5,465,994 | A * | 11/1995 | Commier et al. | 280/602 |
| 5,944,335 | A * | 8/1999 | Riepler | 280/602 |
| 6,158,747 | A * | 12/2000 | Magnani | 280/11.14 |
| 6,237,932 | B1 * | 5/2001 | Zanco et al. | 280/602 |
| 6,270,108 | B1 * | 8/2001 | Phelipon et al. | 280/602 |
| 2003/0111824 | A1 * | 6/2003 | Riepler | 280/610 |
| 2004/0046362 | A1 * | 3/2004 | Restani | 280/602 |
| 2008/0305330 | A1 | 12/2008 | Rancon | |
| 2009/0051142 | A1 | 2/2009 | Francois et al. | |
| 2009/0160161 | A1 * | 6/2009 | Bouttie | 280/607 |
| 2010/0019463 | A1 | 1/2010 | Rancon | |
| 2010/0148472 | A1 | 6/2010 | Phelipon et al. | |

FOREIGN PATENT DOCUMENTS

| | | | |
|---|---|---|---|
| DE | 297 09 403 | U1 | 4/1998 |
| EP | 0 521 272 | A1 | 1/1993 |
| EP | 0 733 386 | A2 | 9/1996 |
| EP | 0 966 992 | A1 | 12/1999 |

* cited by examiner

*Primary Examiner* — John Walters
*Assistant Examiner* — James Triggs
(74) *Attorney, Agent, or Firm* — Greenblum & Bernstein, P.L.C.

(57) ABSTRACT

A gliding board including a primary core positioned between a lower sub-assembly and an upper sub-assembly, the upper sub-assembly and the lower sub-assembly including at least one first upper reinforcement and one first lower reinforcement, respectively, extending longitudinally over at least two thirds of the length of the gliding board, and further including a frictional damping arrangement. The damping arrangement includes a blade having a thickness of less than 2 mm and a structure that enables the sliding of at least one of the ends of the blade. The damping arrangement is positioned between the first lower reinforcement and the first upper reinforcement, and the distance separating the damping arrangement from the first upper reinforcement, or from the first lower reinforcement can range, for example, between 0 mm and four times the thickness of the blade.

26 Claims, 6 Drawing Sheets

Fig: 3
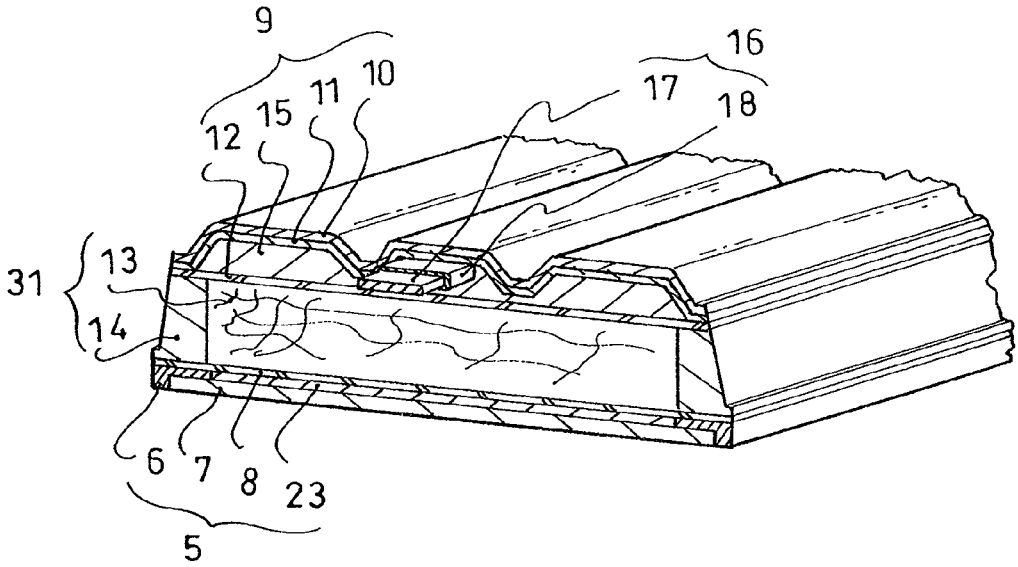
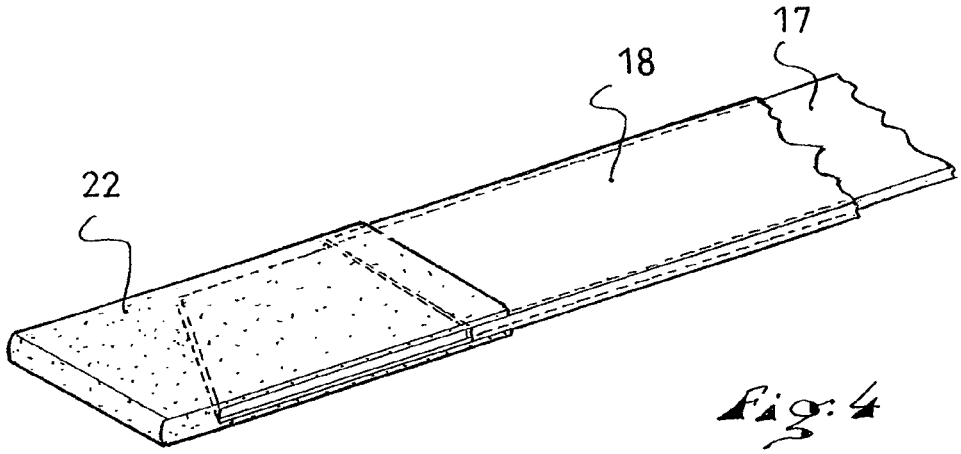
Fig: 4

GLIDING BOARD

CROSS-REFERENCE TO RELATED APPLICATION

This application claims priority under 35 U.S.C. §119 of French Patent Application No. 09 03107, filed on Jun. 26, 2009, the disclosure of which is hereby incorporated by reference thereto in its entirety.

BACKGROUND OF THE INVENTION

1. Field of the Invention

The present invention relates to a damping arrangement for a gliding board, in particular for an alpine ski, as well as for gliding boards of other types, such as snowboards and Nordic skis, the latter including, e.g., cross-country skis. In the following description, unless specifically described otherwise, reference made to a ski is for the purpose of convenience and not for the purpose of limiting the scope of the invention from gliding boards as mentioned above. The invention relates more particularly to an improvement to a damping arrangement of the aforementioned type, as well as to a ski, or other gliding board, equipped with such a device or arrangement. The method is also directed to a method of manufacturing such a gliding board.

2. Description of Background and Other Information

It is known to make the body of a ski to have a more or less flexible structure.

Various types of skis are known, and there are numerous variations among them. Such skis are comprised of an elongated beam, the front end of which is curved upward to constitute the shovel, the rear end also being curved upward more slightly to constitute the tail.

Currently available skis generally have a composite structure in which various materials are combined, so that each of them cooperates with the others in an optimal manner, particularly in terms of the distribution of mechanical stresses during use of the ski. Thus, the structure generally includes peripheral protective elements, internal reinforcement elements to resist flexion and torsion forces, as well as a core. These elements are assembled by gluing or by injection molding, the assembly being carried out generally under heat in a mold having the final shape of the ski, with a front portion sharply raised into a shovel, a rear portion slightly raised into a tail, and a cambered central portion.

In spite of their desire to make high quality skis, manufacturers have not, to date, produced a highly efficient ski that performs satisfactorily under all conditions of use.

Currently available skis have a number of disadvantages, particularly that of poor performance when oscillations are produced by vibrations or flexing of the ski. Indeed, persistent vibrations cause a loss of adherence of the ski to the snow or terrain and, therefore, result in poor steering of the ski, i.e., a lessened control of the ski. Therefore, it is very important to damp the vibrations; and some solutions have been proposed, such as those disclosed in patent documents DE 297 09 403, EP 0 521 272, EP 0 733 386, and U.S. Pat. No. 5,332,252, for example. However, the effects of these damping devices are in fact quite minor and imperceptible to the skier.

Document DE 297 09 403 discloses a gliding board with a damping arrangement comprised of a channel in which a friction piston slides freely. The friction piston can be comprised of parallelepipedic or cylindrical rods. In both cases, the friction piston has a certain thickness which is greater than a third of the total thickness of the ski. This substantial thickness of the friction elements in relation to the total thickness of the ski causes a substantial alteration in the characteristics of the ski, in particular the flexion and torsion characteristics. In addition, the excessive thickness of the damping arrangement in relation to the total thickness of the ski is such that the damping arrangement is close to the neutral plane of the ski. When the beam of the ski is subject to upward flexion, the upper portion of the beam is subject to compressive stresses, whereas the lower portion of the beam is subject to tensile stresses. The neutral plane of the beam corresponds to an imaginary surface comprised of all points of the beam which are subject neither to tension nor to compression. The damping arrangement of a gliding board is more efficient as it is farther from the neutral plane thereof. In the case of the ski disclosed in DE 297 09 403, this characteristic is far from extant.

The documents EP 0 521 272 and US 5,332,252 disclose a ski having a damping arrangement comprised of a flexion blade connected to the ski via a friction device. Such a system has numerous disadvantages, in particular those relating to the damping arrangement being separate from the structure of the ski or at least outside of the reinforcing layers of the ski structure. The mounting of the damping arrangement on the ski is carried out mainly after the primary manufacturing stage of the ski, i.e., after the molding of the ski, such as by injection. In addition, the mounting on the outer surface of the ski considerably hinders the decoration thereof and especially limits possibilities for the design and external appearance of the ski.

The document EP 0 733 386 discloses a ski having a damping arrangement comprised of a plurality of blades positioned one on top of another. The damping arrangement is distinct from the remainder of the ski and is comprised of a closed box in which the blades and the friction layers form a stack, the box being inserted between the upper reinforcement and the top of the ski, i.e., the top of the ski being comprised of the protective and decorative layer. Here again is a damping arrangement which considerably modifies the mechanical characteristics of the ski, inasmuch as the damping device is heavy and thick.

The documents EP 0 966 992 and U.S. Pat. No. 6,237,932 disclose a ski, the sides of which are provided with damping elements for damping only the specific unwanted vibrations that propagate between the running edges and the top of the ski. These damping elements are made of flexible or viscoelastic material and function by means of compression.

SUMMARY

The present invention overcomes the various disadvantages mentioned above and proposes a particularly simple, efficient, and reliable solution to the problems related to damping vibrations.

The invention is directed to a gliding board equipped with a frictional damping arrangement, which is simple and inexpensive insofar as it can be integrated directly into the gliding board, during the injection phase during manufacture thereof.

To this end, the damping arrangement according to the invention is adapted to damp the vibrations of a gliding board having a length L, the gliding board comprising a primary core positioned between a lower sub-assembly and an upper sub-assembly, the upper sub-assembly and the lower sub-assembly comprising at least one first upper reinforcement and at least one first lower reinforcement, respectively, extending longitudinally over at least two thirds of the length of the gliding board. The included frictional damping arrangement includes a blade having a thickness of 2 millimeters (mm) or less than 2 mm, and a structure arranged to enable at least one of the ends of the blade to slide. The damping arrangement is positioned between the first lower reinforcement and the first upper reinforcement, and the distance separating the damping arrangement from the first upper reinforcement or from the first lower reinforcement, ranges from 0 mm and four times the thickness of the blade.

According to one or several other characteristics of the gliding board, taken alone or in combination:

- the structure enabling the sliding is comprised of a sleeve, whose length is greater than a quarter of the length of the gliding board;
- the damping arrangement is located between the primary core and the first intermediate reinforcement;
- the blade and its sleeve have a thickness less than 2.5 mm or, in a particular embodiment, less than 1.8 mm;
- the blade includes a portion that is fixed with respect to the remainder of the gliding board, in a central zone of the gliding board, and at least one free end, capable of sliding with respect to the remainder of the gliding board, the central zone corresponding to a zone having a length approximately equal to 600 mm and centered on the boot center line (MC);
- the damping arrangement includes a blade having two ends that slide freely, and a central portion fixed at to the gliding board;
- the damping arrangement includes at least two blades, each being wrapped in, or surrounded by, a sleeve, one of the two blades being positioned in the front portion of the gliding board, whereas the other is positioned in the rear portion of the gliding board;
- the damping arrangement includes at least two blades, each being wrapped in, or surrounded by, a sleeve, the two blades being positioned side-by-side in the front portion or in the rear portion of the gliding board;
- the width of the blade, the sum of the respective widths of the two blades positioned side-by-side, ranges between 6 mm and 30 mm;
- the upper sub-assembly comprises at least one second upper reinforcement extending longitudinally over at least a third of the length of the gliding board and has a modulus higher than 25,000 MPa, the frictional damping arrangement being positioned between the first upper reinforcement and the second upper reinforcement;
- the upper reinforcement also includes a secondary core positioned between the first upper reinforcement and the second upper reinforcement, the damping arrangement being positioned in a cavity arranged in the secondary core;
- the damping arrangement includes a cap positioned on the free end of the blade, the cap including a material having a hardness of less than 50 Shore A;
- the free end of the blade is capable of movement in a range from 1 mm to 3 mm.

The damping arrangement according to the invention is particularly efficient because it acts on a substantial portion of the length of the gliding board, and because it is positioned as far as possible from the neutral plane of the gliding board, whether it is positioned above or below the neutral plane. That is, the damping arrangement is spaced from a neutral plane along its entire length. However, the weight added by the damping arrangement is minimal compared to the damping which it performs, and it can be substantially imperceptible, it only very slightly modifying the mechanical characteristics of the gliding board. Moreover, because it is positioned under the first upper reinforcement, or on the first lower reinforcement, the damping arrangement is completely integrated into the structure of the ski, and it has no effect on the external shape of the gliding board, i.e., whether the sliding board is a ski or a snowboard, for example.

BRIEF DESCRIPTION OF THE DRAWINGS

Other characteristics and advantages of the invention will become apparent from the description which follows, with reference to the annexed drawings which are provided only by way of non-limiting examples, and in which:

FIG. 3 is a perspective cross-sectional view of the ski according to the first embodiment;

FIG. 4 is a perspective view of a detail of the first embodiment.

DETAILED DESCRIPTION

Figure 1:
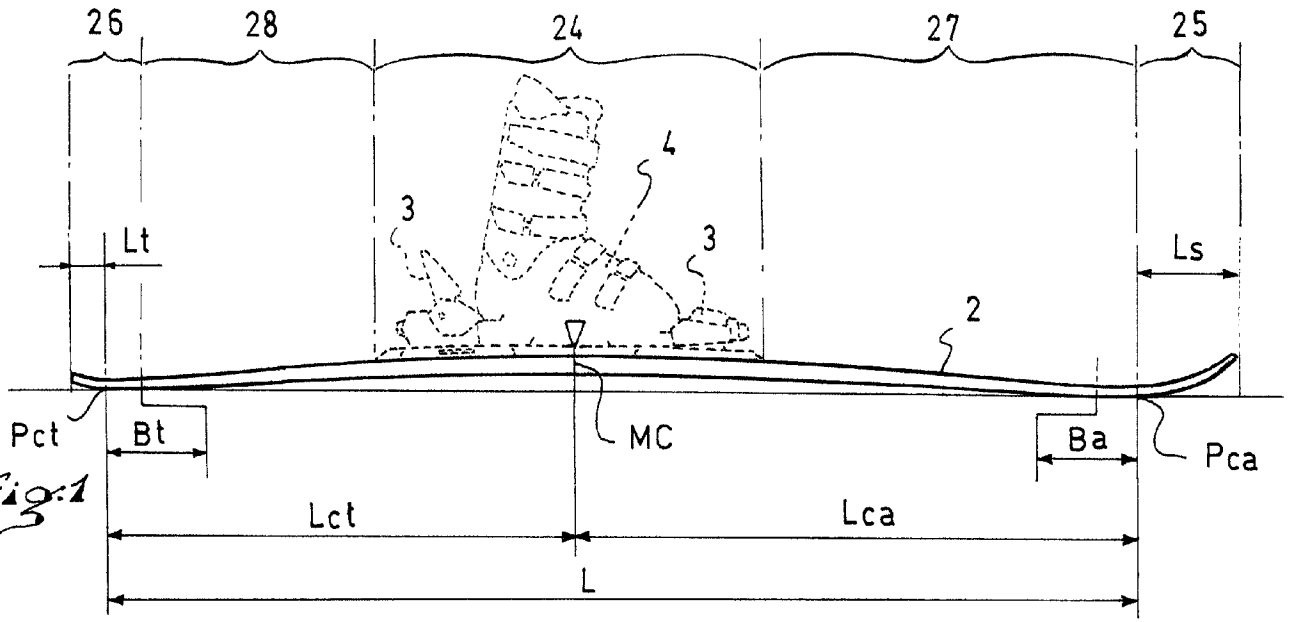
FIG. 1 is a side view of a ski according to a first embodiment of the invention.

The gliding board 1 shown in FIG. 1 is a ski 2 provided for the practice of alpine skiing. As mentioned above, however, the invention encompasses snowboards and gliding boards for the practice of other disciplines. The ski 2 is comprised of an elongated beam having its own distribution of thickness, width and, therefore, of its own stiffness. The ski includes a central portion 24, or boot-mounting zone, on which safety bindings 3 are fixed for mounting a boot 4. As shown in FIG. 1, the safety bindings comprise a front abutment and a heel piece. In a known manner, in this central portion the ski has a transversely extending line, or reference mark, referred to as the "boot center" MC. The boot center is an aid provided by the ski manufacturer to assist the user, or the technician assembling the bindings, to position the bindings more easily in the most appropriate location on the ski. The boot center MC represents the point on the ski that corresponds to the location representing the center of the boot with the boot mounted on the ski. A corresponding reference mark is also typically affixed on the article of footwear, such as an alpine ski boot or a back country ski boot, for example.

The front tip of the ski 2 is raised to form the shovel 25. The rear tip of the ski 2 can also be raised to form the tail 26. Between the central zone 24 and the shovel is defined what is generally referred to as the front portion or segment 27 (or "front") of the ski, whereas between the central zone 24 and the tail 26 is defined what is referred to as the rear portion or segment 28 (or "rear") of the ski. When the ski rests on a planar surface, the two points supporting the ski against the planar surface, when viewed in a side view such as in FIG. 1, are referred to as the front contact point Pca and the tail contact point Pct. In three dimensions, the front and rear contact points Pca, Pct are points along a front contact line and a rear contact line, respectively.

The ski can therefore be described with regard to the following dimensions: the overall length L of the ski is measured between the rear tip to the front tip of the ski, the shovel length Ls is measured between the front contact point Pca and the front tip of the ski, the tail length Lt is measured between the rear tip of the ski and the tail contact point Pct, the front contact length Lca is measured between the boot center and the front contact point, and the tail contact length Lct is measured between the tail contact point and the boot center MC.

The ski 2 shown in FIGS. 1 to 4 has a so-called sandwich construction. In a known manner, it is comprised of an intermediate structure 31 interposed between a lower sub-assembly 5 and an upper sub-subassembly 9. The intermediate structure 31 includes a primary core 13 framed by sidewalls 14. In the example shown here, the primary core 13 is made of wood and the sidewalls 14 are made of a plastic material such as a material of the ABS type. Other materials are also suitable within the scope of the invention. Similarly, other types of constructions are also possible, such as those for a cap ski, a composite frame ski, a box structure ski, a shell ski, etc. Exemplary alternative structures in this regard are disclosed, e.g., in U.S. Patent Application Publication No. 2008/0305330 and in U.S. Patent Application Publication No. 2009/0051142, the disclosures of which are hereby incorporated by reference in their entireties.

The lower sub-assembly 5 includes a lowermost layer comprising the gliding sole 7, a layer comprising a first lower reinforcement 8, a layer comprising a second lower reinforcement 23, and two running edges 6 positioned on each side of the gliding sole 7. The upper sub-assembly 9 includes a protective layer 10, also referred to as the top of the ski, a layer comprising a first upper reinforcement 11 and a layer comprising a second upper reinforcement 12. A secondary core 15 is positioned between the first upper reinforcement 11 and the second upper reinforcement 12.

According to the invention, a frictional damping arrangement 16, or damping device or damping structure, is positioned inside the structure of the gliding board, in the vicinity of and below the first upper reinforcement 11. In other words, in the illustrated embodiment, e.g., the damping arrangement is positioned in the ski between the neutral plane and the first upper reinforcement 11. In the first embodiment of the invention, the damping arrangement 16 is positioned between the first upper reinforcement 11 and the second upper reinforcement 12. The frictional damping arrangement includes a blade 17 surrounded by a sleeve 18 and placed in contact with the first upper reinforcement 11.

The damping arrangement 16, over its entire length Lma, is completely embedded inside the structure of the ski. The complete integration of the damping arrangement within the structure of the ski renders it completely impervious to infiltration of any material (such as water, dust, etc.) which could be harmful to the operation or performance of the damping arrangement and, consequently, to that of the ski. The damping arrangement could be entirely hidden from the ski user's view, but it is possible to provide a transparent or translucent cover or other such structure in the area of the core 13 and/or in the area of the upper sub-assembly 9, and/or in the area of the lower sub-assembly 5, in order to provide one or more viewing windows. Such viewing windows enable all or certain portion(s) of the damping arrangement to be visible to the user.

Another means to render the damping arrangement visible comprises arranging it so that only a portion thereof is embedded inside the structure of the ski. In such a case, it is nevertheless necessary that a majority of the length Lma of the damping arrangement be embedded within the structure of the ski, and that a sealing arrangement be provided to prevent dust and water, and other unwanted material or debris, from penetrating inside the structure of the ski.

Figure 2:
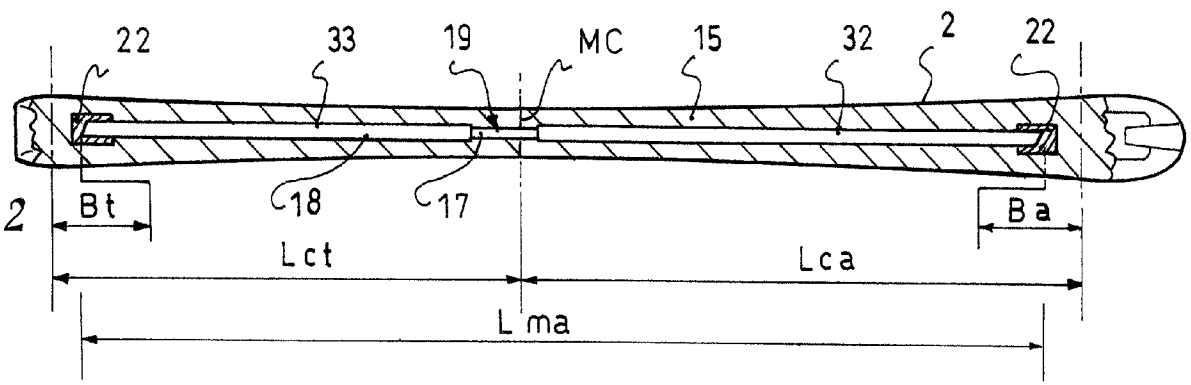
FIG. 2 is a top view of the ski of FIG. 1.

FIG. 2 shows a top view of the ski according to the first embodiment of the invention, in partial cross section, or cutaway, in order to show the positioning of the damping arrangement, i.e., the blade 17 and its sleeve 18. As shown, the blade 17 extends over a major portion of the length of the ski. In fact, the blade extends approximately from the tail contact point Pct to approximately the front contact point Pca. The sleeve 18 includes two portions, namely, the front sheath 32 and the rear sheath 33. The two portions of the sleeve 18 are not contiguous, and they leave a portion of the blade exposed, i.e., not surrounded by the sleeve 18, in the center of the ski. During the manufacture of the ski, the area of the blade that is not surrounded by the sleeve 18, and which is thus in direct contact with the first upper reinforcement 11, is completely fixed to the latter and, thereby, affixed to the ski in the central zone thereof. On the other hand, the portions of the blade 17 that are surrounded by the sleeve 18 retain their ability to slide inside the sleeve, even if the sleeve is securely fixed to the reinforcement and to the secondary core 15.

According to the invention, the portion of the blade that is fixed with respect to the ski, i.e., the anchoring zone 19, is positioned within a 600 mm longitudinal segment of the ski centered on the boot center MC. In an alternative embodiment, the longitudinal segment has a length of 200 mm, centered on the boot center.

According to an alternative to the first embodiment of the invention, the anchoring zone 19 is replaced with a mechanical anchoring carried out by means of a rivet, a screw, or a pin extending through the blade. In such an alternative, the blade 17 is entirely surrounded by a sleeve 18, which does not comprise any interruption in the central portion. However, the sleeve and the blade are bored in the area of the anchoring zone, and the boring cooperates with a mechanical anchoring mechanism fixing the blade to the remainder of the ski in the central zone of the ski.

According to the invention, the damping arrangement extends over a substantial length of the front portion and/or rear portion of the ski. In the first embodiment, the damping arrangement extends to the front and to the rear. If the rear tip of the ski is considered the starting point for the length measurements, the front end of the blade is in on the side of the front contact point Pca at the front of the ski, in a lengthwise range Ba equal to 20% of the length of the front contact Lca. The rear end of the blade is beyond the tail contact point Pct, in a lengthwise range Bt equal to 20% of the tail contact length Lct.

Under these conditions, the zone in which the energy generated by the vibrations of the ski is frictionally damped is concentrated at the front 27 of the ski, close to the front contact point Pca, without extending into the shovel. In particular, this is one of the reasons why a gliding board according to the invention achieves a good compromise between a good damping of vibrations and a behavior of the ski that is reactive, i.e., relatively stiff, or "nervous." In other words, although the vibrations are damped, the gliding board of the invention does not have an amorphous behavior, i.e., it does not have a behavior that is ill-defined, nor characterized as suffering from a lack of response during use.

In the illustrated example of the first embodiment, the length of the ski is approximately 1700 mm, the boot center MC is positioned at 727 mm from the rear tip of the ski. The shovel has a length of 170 mm and the front contact point Pca is located at a distance of 1530 mm from the rear tip of the ski.

Thus, the front contact length Lca is equal to 803 mm (1700-727-170), and the front end of the blade is positioned in the zone defined by the following dimensions: 1409 mm and 1530 mm.

With regard to the rear portion, the tail length Lt is equal to 70 mm; thus, the tail contact length Lct is 757 mm. The rear end of the blade is in the zone defined by the following dimensions: 70 mm to 168.5 mm.

Rather than a single blade extending along the entire length of the ski, the ski can have two blades, including one at the front and the other at the rear, each one surrounded by a sleeve and having their portions in the central zone of the ski extending outside of the sleeve, in order to be anchored against the first upper reinforcement.

In the first embodiment of the invention, the damping arrangement includes a single metallic blade made of a material such as steel or aluminum, the thickness of which ranges between 0.4 mm and 0.7 mm. In a particular example, the blade can be 0.5 mm thick and approximately 12 mm wide.

The sleeve 18 is comprised of a sheath made of braided polyester fiber coated on its outer surface with polyurethane resin. A sheath made of silicone-coated paper can also be used. The damping arrangement can be made with a blade that is coated over most of its length with a material preventing bonding and adhesion with the resin of the upper reinforcement. Like the sleeve, this material would have the function of preventing any portions of the blade, with the exception of the anchoring zone 19, from being affixed to the remainder of the ski.

The dimensions of the blade, i.e., the length and the width, are precisely defined by the desired friction properties. To this end, a test can be conducted to evaluate the sliding force necessary for a blade in a sheath, the sheath and the blade being placed beforehand in a testing device.

Figure 10:
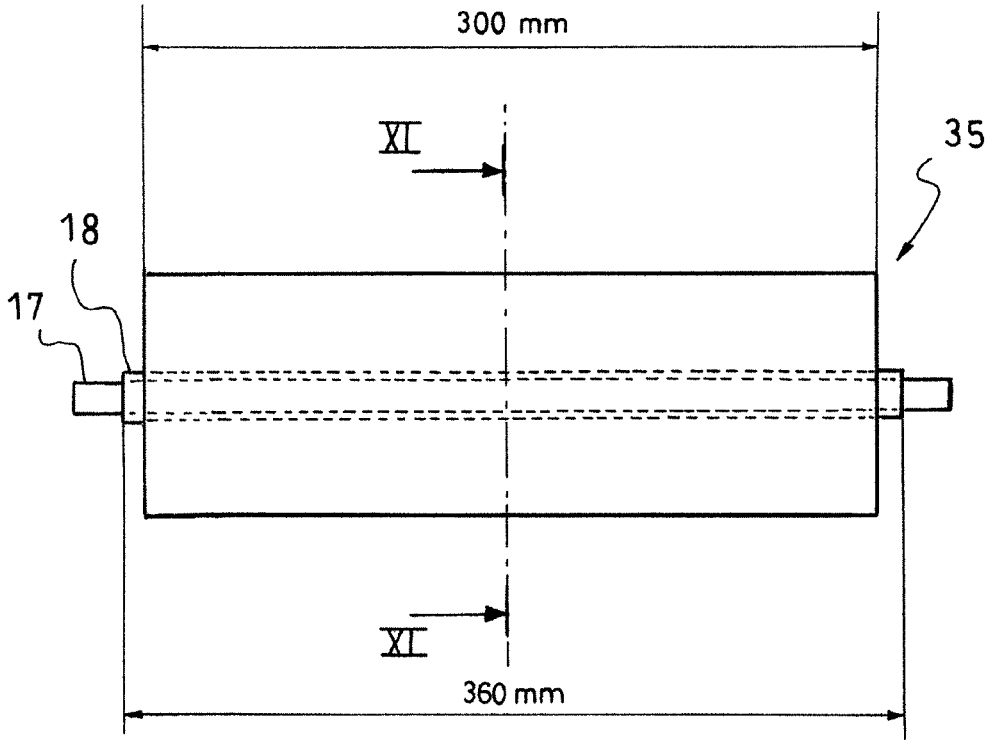
FIG. 10 is a top view of a testing arrangement used to analyze a sliding force.
Figure 11:
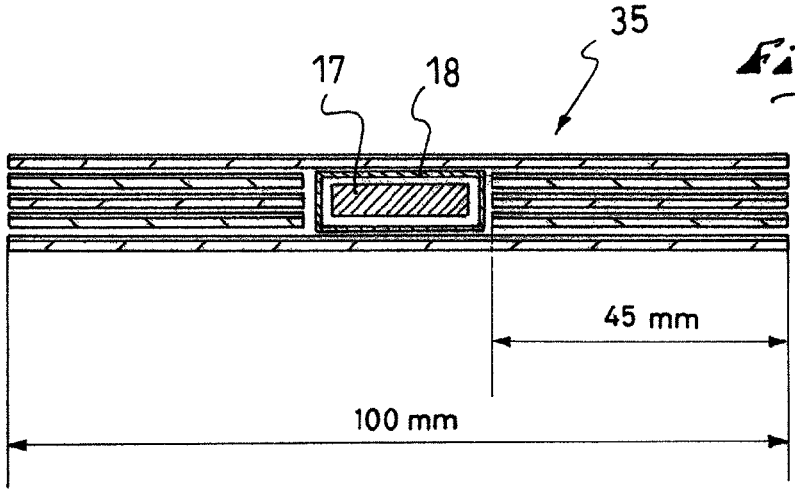
FIG. 11 is a cross-sectional view of the test arrangement of FIG. 10.

FIGS. 10 and 11 show a testing device 35 being used for an evaluation test. The testing device is comprised of a stacking or laminate of resin-preimpregnated glass fabrics. Three layers of fabrics (300×45 mm) are positioned on each side of the sheath. This stacking is covered by larger layers (300×100 mm) on top and bottom. The sheath is 360 mm long; it overlaps on each side of the stacking, and is made of the material that is to be evaluated. The blade is longer than the sheath in order to offer a grip for carrying out the traction test.

Once the stacking is completed, it is placed in a stratification press; the curing cycle is undertaken at a temperature and for a time that are determined as a function of the preimpregnated material selected; then, the testing device is allowed to stabilize for at least 24 hours. At the end of this period, four traction forces are applied, back and forth, to the blade in order to break in the system.

The testing phase itself is carried out on a traction machine, the testing device being fixed thereto. The blade is caused to slide so as to leave only 200 mm of it inside the testing device. Traction is then applied on the blade by measuring the force necessary to make it slide over 30 mm. The reading of the mean value provides an evaluation of the friction of the blade in the sheath.

To obtain a satisfactory damping under normal conditions of use of a gliding board, such as an alpine ski, the blade is sized so that the mean value of the force necessary to slide ranges between 20 N and 80 N. In a particular embodiment, the force range is between 40 N and 60 N.

The sliding test makes it possible to choose the dimensions of the blade or blades, so as to obtain an optimal damping of the gliding board under the conditions of use. For a blade with a thickness ranging between 0.4 mm and 1 mm, a blade with a width ranging between 6 mm and 30 mm is selected. In the case in which several blades are positioned side-by-side, the thickness of the blade is reduced accordingly so that the sum of their width ranges between 6 mm and 30 mm.

The blade 17 is fixed via its central portion to the first upper reinforcement 11 while the ski is being stratified. Indeed, the first upper reinforcement 11 is made of resin-preimpregnated fiber glass fabric. During stratification, the upper surface of the blade that is not covered by the sleeve is glued to the first upper reinforcement 11 due to the resin. If the upper reinforcement is a metallic reinforcement, for example made of aluminum, a film of adhesive can be provided to ensure the adhesion of the blade to the upper reinforcement. In the case in which, as described below, the damping arrangement is not in direct in contact with the upper reinforcement, but only near it, means for anchoring the blade to the core can be provided.

In the first embodiment of the invention, the damping arrangement is above the neutral plane. Consequently, during upward flexing of the front and rear tips of the ski, the ends of the blade tend to come close to, or move toward, the tips of the ski. In order for this to occur, expansion spaces are provided to receive the ends of the blade.

In FIGS. 2 and 4, these expansion spaces are shown, i.e., the front and rear ends of the blade are covered by a cap 22, or cover, made of a flexible material. The constituent material of the end cap 22, made of elastomer, e.g., has a hardness of less than 60 Shore A. Thus, the front and rear ends of the blade can be forced through the end cap 22, without the cap opposing offering much resistance. In order for the damping arrangement to operate properly, the blade 17 can be continuously covered by the sleeve 18 and the end cap 22, without any portion of the blade 17 being exposed to contact with the resin of the upper reinforcement. In practice, the end cap 22 is arranged such that it also covers the end of the sleeve 18.

Each of the caps 22 is comprised of a parallelepiped having a slightly larger cross section than the cross section of the sleeve 18. The cap is split to facilitate the penetration of the blade 17. In an alternative embodiment of the invention, the caps are made of a transparent or translucent material; and a window is provided in the first upper reinforcement in order to render the ends of the blade visible from the outside of the ski. It is then possible to show the movement of the ends of the blade during flexing of the ski. During normal use, the ends of the blade have a travel ranging between 1 mm and 3 mm. The ends of the blade are cut along an oblique line in relation to the longitudinal axis in order to make their movement more visible.

The damping arrangement constitutes an addition of weight of less than 100 g for a ski 1700 mm long, which represents a very small weight considering its efficiency, in particular because it acts on a major proportion of the length of the ski.

Figure 5:
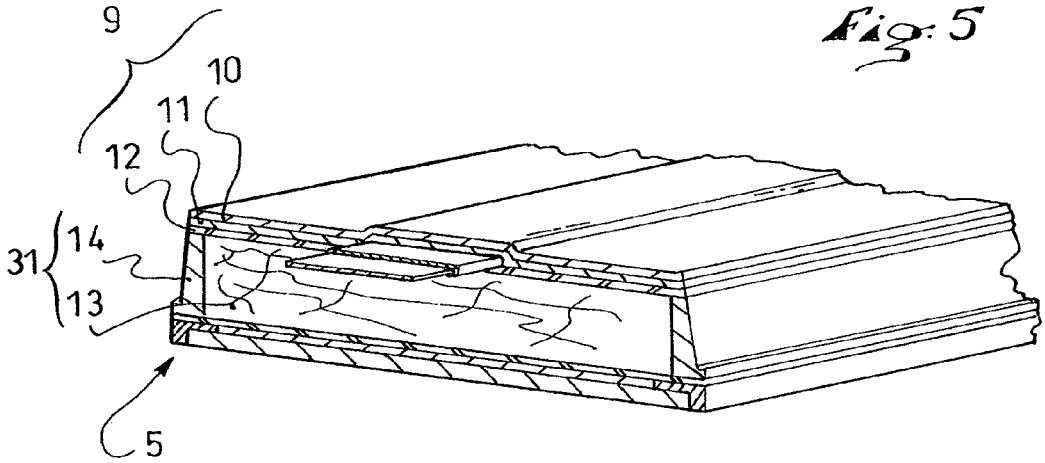
FIG. 5 is a perspective cross-sectional view according to a second embodiment for the invention.

FIG. 5 shows a perspective cross-sectional view of the ski according to a second embodiment of the invention. As in the preceding embodiment, the structure shown in FIG. 5 is that of a sandwich construction ski. It is comprised in a known manner of an interposed structure 31 positioned between a lower sub-assembly 5 and an upper sub-assembly 9. The interposed structure 31 includes a primary core 13 framed by sidewalls 14. The upper sub-assembly 9 is comprised of a protective layer 10, also referred to as the top of the ski, a first upper reinforcement 11 and a second upper reinforcement 12.

As in the preceding embodiment, the damping arrangement is positioned between the first upper reinforcement 11 and the second upper reinforcement 12. Conversely, unlike the preceding embodiment, the two upper reinforcements are positioned on one another, leaving therebetween only a space that is sufficient for positioning the damping arrangement 16. This damping arrangement is comprised of a blade 17 affixed to the upper reinforcements in the central zone of the ski and is capable of sliding in a sleeve 18.

The sleeve 18 is obtained by the wrapping of the blade in a silicone-coated paper. This is a sheet of paper coated with silicone in a proportion of 80 g/m$^2$. The sleeve covers the blade over a major portion of its length, leaving exposed only the central portion thereof. The central portion of the blade is affixed between the second upper reinforcement 12, which is an aluminum plate, e.g., and the first upper reinforcement 11, which is comprised of a resin-impregnated fiber fabric cloth.

Figure 6:
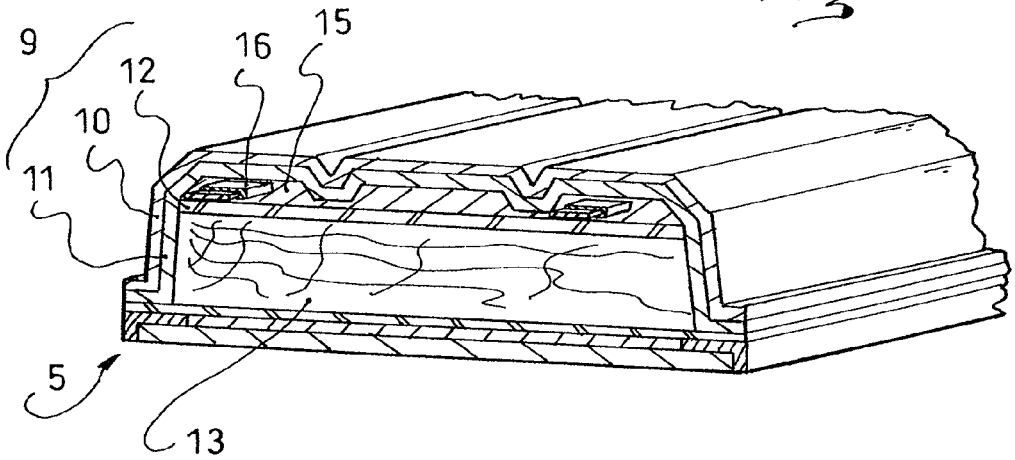
FIG. 6 is a perspective cross-sectional view according to a third embodiment of the invention.
Figure 7:
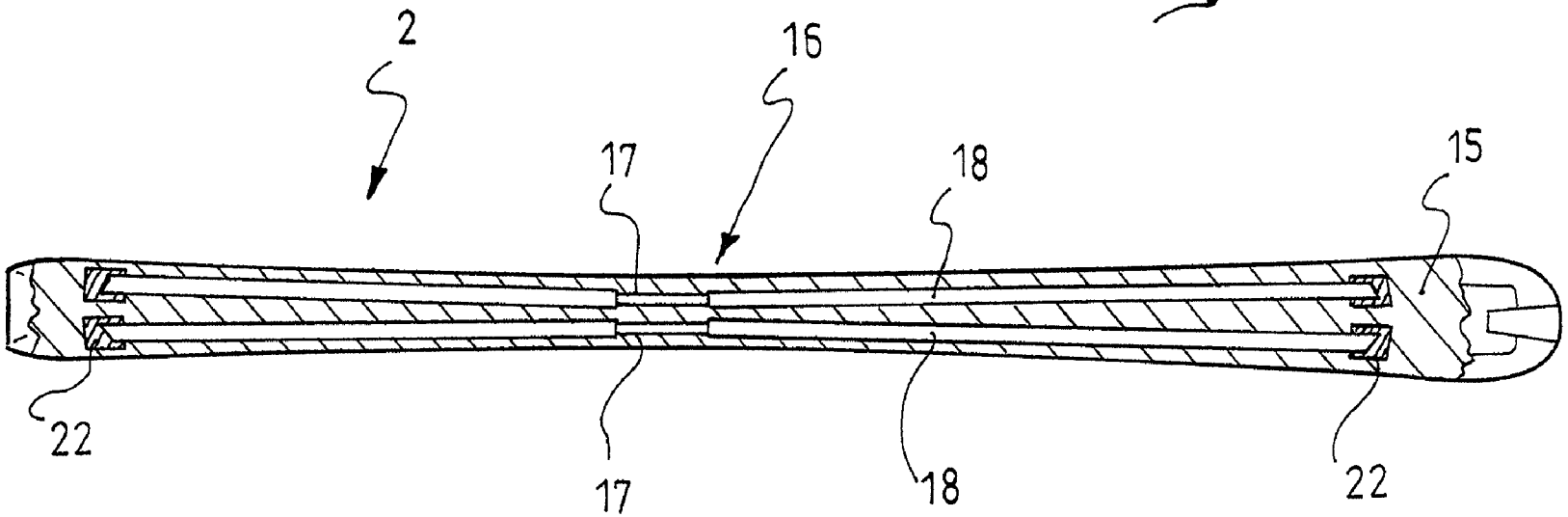
FIG. 7 is a top view of the ski according to the third embodiment of the invention.

FIGS. 6 and 7 show a third embodiment of the invention, in which the damping arrangement is comprised of two substantially parallel blades. As a specific embodiment, each blade is arranged so as to be substantially parallel to the dimension line that is adjacent thereto. The ski 2 includes a lower sub-assembly 5, a core 13, and an upper sub-assembly 9. The upper sub-assembly 9 is comprised of a protective layer 10, also referred to as the top of the ski, a first upper reinforcement 11, and a second upper reinforcement 12. A secondary core 15 is positioned between the first upper reinforcement 11 and the second upper reinforcement 12. Longitudinal housings are arranged in the secondary core 15 to receive the damping arrangement.

Right and left blades can be chosen that are strictly identical, or they can be chosen to have different characteristics. The latter possibility provides for the ability to manufacture nonsymmetrical pairs of skis, i.e., where the left ski is different from the right ski.

Figure 8:
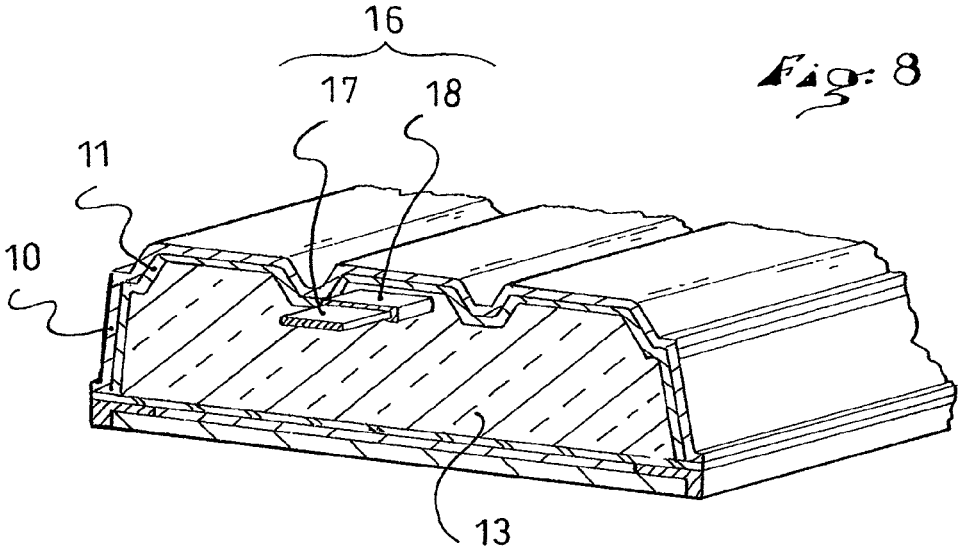
FIG. 8 is a perspective cross-sectional view according to a fourth embodiment of the invention.

FIG. 8 shows a fourth embodiment of the invention, in which the damping arrangement is positioned in the primary core, in the vicinity of the first upper reinforcement 11. In this embodiment, the damping arrangement 16 includes a blade 17 entirely surrounded by a sleeve 18 over its entire length. The blade and its sleeve are bored in their central portion. During the manufacture of the ski, its components, including the damping arrangement but excluding the core, are positioned in the mold; then the material of the primary core 13 (i.e., such as a synthetic material or foam, such as, for example, PU) is injected. A spacer system ensures, before the injection of the core, that the damping arrangement is properly positioned with respect to the first upper reinforcement 11. The adequate positioning of the damping arrangement is that in which the distance which separates it from the first upper reinforcement is less than four times the thickness of the blade. In the example shown, the blade has a thickness of 0.5 mm, so that the damping arrangement is positioned such that the distance separating the upper surface of the sleeve from the lower surface of the upper reinforcement is less than 2 mm.

The damping arrangement is anchored to the ski during the hardening of the core due to the material of the core which confines it. In particular, the blade, in the area of its central portion, is anchored to the core due to the material which has penetrated in the bore arranged therein.

Examples of methods of manufacturing gliding boards, or skis, such as by means of injection molding are disclosed in U.S. Pat. Nos. 5,183,618 and 5,449,425, the disclosures of which are hereby incorporated by reference thereto in their entireties.

Figure 9:
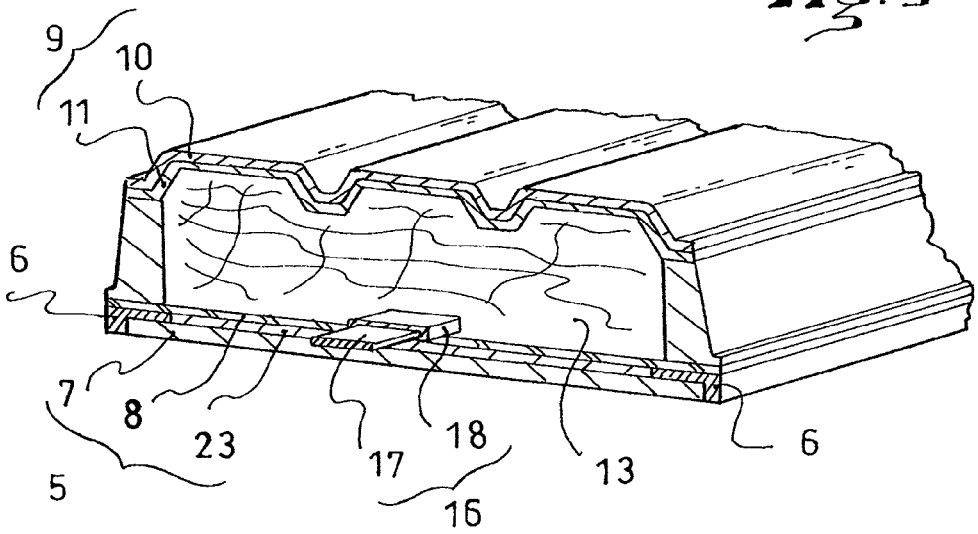
FIG. 9 is a perspective cross-sectional view according to a fifth embodiment of the invention.

FIG. 9 shows a fifth embodiment of the invention. The gliding board is a sandwich structure ski. It is comprised of a lower sub-assembly 5, comprising a first lower reinforcement 8, a second lower reinforcement 23, a gliding sole 7 and of a pair of running edges 6, as well as an upper sub-assembly 9 comprising a top 10 and a first upper reinforcement 11; and a single primary core 13.

The core 13 is made of wood. A channel capable of receiving the damping arrangement 16 is made in the lower portion of the core. The damping arrangement 16 is placed in contact with the first lower reinforcement 8. As in the first embodiment, the damping arrangement includes a blade 17 extending over a major portion of the length of the ski and a sleeve 18 comprising a front sheath and a rear sheath. The two sheaths are disjoined so as to leave, in the center, an exposed blade portion that is fixed to the structure of the ski by gluing during polymerization of the resin of the first lower reinforcement 8.

In the fifth embodiment, the damping arrangement is above the first lower reinforcement and below the neutral plane, and in particular as far from the neutral plane as possible, in order to guarantee its maximum efficiency.

The invention is not limited to the several embodiments described here by way of examples, and it includes any equivalent embodiment.

Also, this invention illustratively disclosed herein, suitably may be practiced in the absence of any element which is not specifically disclosed herein.

The invention claimed is:

1. A gliding board comprising:

a length;

an upper sub-assembly comprising at least one first upper reinforcement extending longitudinally along at least two-thirds of the length of the gliding board;

a lower sub-assembly comprising at least one first lower reinforcement extending longitudinally along at least two-thirds of the length of the gliding board;

a primary core positioned between the lower sub-assembly and the upper sub-assembly;

a frictional damping arrangement extending longitudinally along the length of the ski, the frictional damping arrangement having a length;

through a majority of the length of the frictional damping arrangement, the frictional damping arrangement is completely embedded within a structure of the gliding board;

the frictional damping arrangement comprising:

at least one blade having a thickness of less than 2 mm and extending longitudinally between a first end and a second end;

a structure enabling the at least one of the ends of the blade to slide relative to the structure of the gliding board;

the frictional damping arrangement is positioned between the first lower reinforcement and the first upper reinforcement;

a distance between the frictional damping arrangement and one of the first upper reinforcement and the first lower reinforcement ranges between 0 mm and four times the thickness of the at least one blade.

2. A gliding board comprising:

a length;

an upper sub-assembly comprising at least one first upper reinforcement extending longitudinally along at least two-thirds of the length of the gliding board;

a lower sub-assembly comprising at least one first lower reinforcement extending longitudinally along at least two-thirds of the length of the gliding board;

a primary core positioned between the lower sub-assembly and the upper sub-assembly;

a frictional damping arrangement extending longitudinally along the length of the ski, the frictional damping arrangement having a length;

through a majority of the length of the frictional damping arrangement, the frictional damping arrangement is completely embedded within a structure of the gliding board;

the frictional damping arrangement comprising:

at least one blade having a thickness of less than 2 mm and extending longitudinally between a first end and a second end;

a structure enabling the at least one of the ends of the blade to slide relative to the structure of the gliding board;

the frictional damping arrangement is positioned between the first lower reinforcement and the first upper reinforcement;

a distance between the frictional damping arrangement and one of the first upper reinforcement and the first lower reinforcement ranges between 0 mm and four times the thickness of the at least one blade;

the structure enabling the at least one of the ends of said blade to slide relative to the structure of the gliding board comprising a sleeve having a length greater than one-fourth the length of the gliding board.

3. A gliding board according to claim 1, wherein:

the frictional damping arrangement is located between the primary core and the first upper reinforcement.

4. A gliding board according to claim 2, wherein:

the blade and the sleeve have a combined thickness of less than 2.5 mm.

5. A gliding board according to claim 2, wherein:

the blade and the sleeve have a combined thickness of less than 1.8 mm.

6. A gliding board according to claim 1, wherein:

the blade includes a portion fixed against sliding relative to said structure of the gliding board, said portion of the blade being positioned in a central zone of the gliding board; and the blade includes at least one free end capable of sliding with respect to said structure of the gliding board, the central zone of the gliding board having a length approximately equal to 600 mm and centered on a boot center line of the gliding board for receiving a center of a boot to be mounted on the gliding board.

7. A gliding board according to claim 1, wherein:

the first and second ends of the blade of the frictional damping arrangement slide freely and a central portion of the blade is fixed against sliding relative to the gliding board.

8. A gliding board according to claim 1, wherein:

the one blade of the frictional damping arrangement is a first blade;

the frictional damping arrangement further comprises a second blade;

the structure enabling the at least one of the ends of said blade to slide relative to the structure of the gliding board comprises sleeves surrounding respective ones of the first and second blades;

the first blade is positioned in a front portion of the gliding board, and the second blade is positioned in a rear portion the gliding board.

9. A gliding board according to claim 1, wherein:

the one blade of the frictional damping arrangement is a first blade;

the frictional damping arrangement further comprises a second blade;

the structure enabling the at least one of the ends of the blade to slide relative to the structure of the gliding board comprises sleeves surrounding respective ones of the first and second blades;

the first and second blades are positioned side-by-side in a front portion of the gliding board or in a rear portion of the gliding board.

10. A gliding board according to claim 6, wherein:

the blade has a width within a range between 6 mm and 30 mm.

11. A gliding board according to claim 8, wherein:

each of the first and second blades has a respective width;

a sum of the respective widths of the first and second blades is within a range between 6 mm and 30 mm.

12. A gliding board according to claim 9, wherein:

each of the first and second blades has a respective width;

a sum of the respective widths of the first and second blades is within a range between 6 mm and 30 mm.

13. A gliding board according to claim 1, wherein:

the upper sub-assembly further comprises at least one second upper reinforcement extending longitudinally over at least one-third of the length of the gliding board;

the frictional damping arrangement is positioned between the first upper reinforcement and the second upper reinforcement.

14. A gliding board according to claim 13, further comprising:

a secondary core positioned between the first upper reinforcement and the second upper reinforcement;

the frictional damping arrangement being positioned in a cavity arranged in the secondary core.

15. A gliding board according to claim 1, wherein:

the frictional damping arrangement includes a cap positioned on one of the first and second ends of the blade, said one of the first and second ends of the blade being a free end mounted for slidable movement relative to the structure of the gliding board;

the cap comprising a material having a hardness of less than 50 Shore A.

16. A gliding board according to claim 1, wherein:

the frictional damping arrangement includes a cap positioned on one of the first and second ends of the blade, said one of the first and second ends of the blade being a free end mounted for slidable movement relative to the structure of the gliding board, said movement being within a range of 1.0 and 3.0 mm.

17. A gliding board according to claim 1, wherein:

the primary core comprises a synthetic foam.

18. A method of manufacturing the gliding board according to claim 1, said method comprising:

arranging in a mold the following: the upper sub-assembly, the lower sub-assembly, and the frictional damping arrangement; and injecting into the mold a synthetic foam material to comprise said primary core, whereby the frictional damping arrangement is directly integrated into the gliding board.

19. A gliding board according to claim 1, wherein:

the gliding board includes a central boot-mounting zone;

the frictional damping arrangement extends beyond the central boot-mounting zone at least one of forwardly and rearwardly.

20. A gliding board according to claim 2, wherein:

the gliding board includes a longitudinally central boot-mounting zone;

the sleeve extends beyond the central boot-mounting zone at least one of forwardly and rearwardly.

21. A gliding board according to claim 1, wherein:

the frictional damping arrangement does not extend to the neutral plane of the board.

22. A gliding board according to claim 2, wherein:

the frictional damping arrangement does not extend to the neutral plane of the board.

23. A gliding board according to claim 1, wherein:

the blade is a longitudinally slidable blade.

24. A gliding board according to claim 2, wherein:

the blade is a longitudinally slidable blade.

25. A gliding board according to claim 1, wherein:

the structure enabling the at least one of the ends of the blade to slide relative to the structure of the gliding board comprises a structure enabling the at least one of the ends of the blade to slide longitudinally relative to the structure of the gliding board.

26. A gliding board according to claim 2, wherein:

the structure enabling the at least one of the ends of the blade to slide relative to the structure of the gliding board comprises a structure enabling the at least one of the ends of the blade to slide longitudinally relative to the structure of the gliding board.

* * * * *